United States Patent [19]

Kusz

[11] Patent Number: 4,957,210

[45] Date of Patent: Sep. 18, 1990

[54] CHILD RESISTANT CLOSURE

[75] Inventor: Maximillian Kusz, Waterville, Ohio

[73] Assignee: Owens-Illinois Closure Inc., Toledo, Ohio

[21] Appl. No.: 422,219

[22] Filed: Oct. 16, 1989

[51] Int. Cl.[5] ..... B65D 55/02

[52] U.S. Cl. ..... 215/220; 215/246

[58] Field of Search ..... 215/301, 201, 334, 330, 215/217, 218, 219, 220, 246

[56] References Cited

U.S. PATENT DOCUMENTS

| | | | |
|---|---|---|---|
| 3,055,524 | 9/1962 | Glasbrenner | 215/220 |
| 3,795,337 | 3/1974 | Nozawa et al. | 215/219 |
| 3,843,006 | 10/1974 | Naito et al. | 215/220 |
| 3,857,505 | 12/1974 | Mumford et al. | 215/220 |
| 4,410,098 | 10/1983 | Dubs et al. | 215/220 |
| 4,433,789 | 2/1984 | Gibilisco | 215/220 |
| 4,523,688 | 6/1985 | Puresevic et al. | 215/220 |
| 4,673,095 | 6/1987 | Puresevic et al. | 215/220 |
| 4,801,028 | 1/1989 | Puresevic et al. | 215/220 |

FOREIGN PATENT DOCUMENTS

| | | | |
|---|---|---|---|
| 972713 | 8/1975 | Canada | 215/220 |
| 2022064 | 12/1979 | United Kingdom | 215/246 |

*Primary Examiner*—Stephen Marcus

[57] ABSTRACT

A child resistant closure comprising outer and inner nested closure members each of which has a base wall and a peripheral skirt with sets of lugs on the inner surface of the outer base wall and the outer surface of the inner base wall adapted to engage each other when the outer closure is rotated for application to a container, but slip or cam past each other on inclined surfaces when the outer closure is rotated for removal. At least one integral spring finger extends from one base wall toward the other base wall such that the outer closure member is held out of engagement with the inner closure member. To remove the closure, the outer closure member must be pressed downward, while simultaneously being rotated. The camming action of the lugs is then resisted by a frictional engagement of corners of the lugs on the outer closure with inclined surfaces on the lugs on the inner closure.

2 Claims, 2 Drawing Sheets

CHILD RESISTANT CLOSURE

BACKGROUND AND SUMMARY OF THE INVENTION

Child resistant safety closures comprising two nested closure members are well known in the art. Typically, the outer and inner closure members are provided with cooperating sets of lugs which engage each other when the outer closure is rotated in the direction to apply the closure. When the outer closure member is rotated for removal, these lugs cam or ratchet past each other on inclinded surfaces, so that the closure member may not be removed by mere rotation. To provide positive engagement of the inner and outer closure member for removal, the prior art has employed additional sets of cooperating lugs or projections, which are normally held completely separated by some flexible means. To remove these closures, the outer closure member must be variously squeezed, pushed, or otherwise manipulated, to overcome the flexible separating means, and bring the removing lugs into positive engagement.

The prior art devices thus employ different sets of cooperating lugs to apply and remove the closure. In many prior art devices if the separating means is damaged by abuse, storage with a top load, or simply by repeated use, the outer closure will fall into positive engagement with the inner closure thereby eliminating the safety feature. Typical closures of this type are set forth in U.S. Pat. Nos. 3,776,407, 3,946,890, 4,480,759, and British Patent Specification No. 152,999.

Such closures function well in normal usage. However, when a heat shrunk tamper indicating band is applied to the package and the band is shrunk, there is a tendency for the outer closure member or shell to be drawn axially into engagement with the inner closure member or shell.

Accordingly, among the objectives of the present invention are to provide a child resistant closure which obviates and precludes any tendency of the closure members to be in engagement when a tamper indicating band is utilized therewith.

In accordance with the invention, one or more integral resilient wings are provided on the inner surface of the base wall of the outer member or the inner surface of the base wall of the inner member such that the outer member is normally held out of engagement with respect to the inner member and will not be brought into engagement by the shrinkage of a tamper indicating band thereon.

DESCRIPTION

Figure 5:
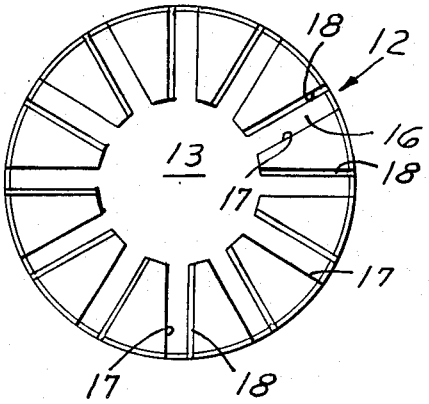
FIG. 5 is a top plan view of the base wall of the inner member.
Figure 6:
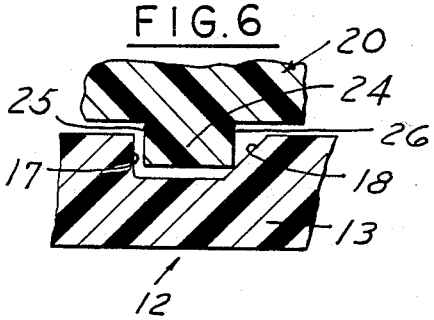
FIG. 6 is a fragmentary sectional view taken along the liner 6—6 showing the relationship between the interengaging parts of the outer closure member and inner closure member.
Figure 7:
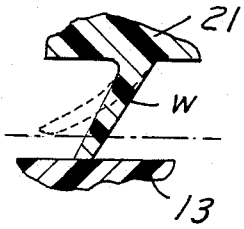
FIG. 7 is a fragmentary sectional view taken along the line 7—7 in FIG. 4 showing the wings provided in accordance with the invention.

Referring to the drawings, the safety closure 10 comprises an inner closure 12 and an outer closure 20. The inner closure 12 has a circular top panel 13, and an annular peripheral skirt 14 depending from the periphery thereof. On the inside surface of the skirt 14, threads 15 are formed to engage cooperating threads T on a container C. The panel 13 is provided with a set of radially disposed lugs 16, of a generally triangular configuration, which project from the top of the panel section 13 (FIG. 5). Looking at the top of the inner closure 12, the lug surface 17 facing a counterclockwise direction are vertical, that is, perpendicular to the surface of the panel. The lug surfaces 18 which face a clockwise direction are inclined from the panel surface to top surface of the lugs 16. The lugs 16 therefore have a rectangular trapezoidal cross section, as best illustrated in FIG. 6.

Figure 4:
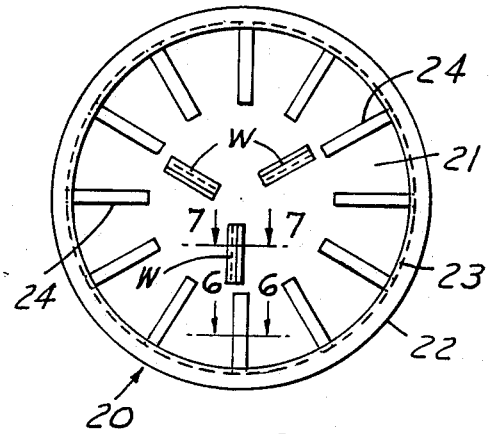
FIG. 4 is a bottom plan view of the base wall of the outer member.

The outer closure 20 comprises a top panel section 21, and an annular skirt section 22 depending from the periphery thereof. The bottom of the annular skirt 22 is thickened to form a retention bead 23. Formed on the inside surface of the panel 21 are integral, downwardly projecting, radial lugs 24 (FIG. 4). Radially extending side surfaces 25 and 26 of lugs 24 are vertical, that is, perpendicular to the surface of panel section 21. Lugs 24 therefore have a rectangular cross section, as illustrated in FIG. 6.

The inner and outer closures 12, 20 are so formed that the inside diameter of the outer closure 20, above the retention bead 23, is slightly greater than the outside diameter of the inner closure 12. The inside diameter of the retention bead 23, however, is somewhat less than the outside diameter of the inner closure 12. Furthermore, the vertical distance between the retention bead 23 and the panel 21 of the outer closure 20 is slightly greater than the height of the inner closure 12. Therefore, when the inner closure 12 is preassembled within the outer closure 20, it is held loosely in place by the retention bead 23, so that a limited axial movement of the inner closure 12 relative to the outer closure 20 is possible. Also, when the top panel section 21 of the outer closure 20 is axially spaced above the panel 13 of the inner closure 12, the outer closure 20 is free to rotate independently of the inner closure 12.

To apply the safety closure, the outer closure 20 is rotated in a clockwise direction, looking from the top. Lugs 24 on panel 21 of outer closure 20 drop into the spaces between the lugs 16 on the top panel 13 of the inner closure 12. Vertical lugs engage the vertical lugs 24, so that rotation of outer closure 20 also rotates inner closure 12, thereby threading it onto the threaded container neck. If the outer closure 20 is rotated in the opposite direction, the inclined surfaces 18 of inner closure lugs 16 will cam the lugs 24 up and over lugs 16. This camming action causes the outer closure 20 to ratchet freely around the inner closure 20, so that a child may not remove the safety closure 10 by mere rotation of the outer closure 20. To remove the closure 10 a substantial downward force on the outer closure 20 must be applied simultaneously with counterclockwise rotation of the outer closure 20. This downward force must be sufficient to resist the upward sliding of lugs 24 on inclined surfaces 18. The frictional engagement of the corner edges of upper lugs 24 with lower lug inclined surface 18 facilitates removal of the safety closure 10. While such engagement is primarily frictional, there is some degree of resilient depression of the edges into the inclined surface 16*b*.

Depending on the coefficient of friction of the material used to manufacture the closure, the angle of inclined surface 18 should be selected for the desired removal force requirement. In the preferred embodiment, both closures are molded of polypropylene, and the appropriate angle is approximately 50° relative to the panel.

In accordance with the invention as shown in FIG. 1–7, a plurality of circumferentially spaced wing W are provided. Each wing W extends generally radially and downwardly at an angle to the axis of the outer member toward the base wall of the inner member. Each wing W normally holds the outer member 20 out of engagement with the inner member 12. When it is desired to remove the closure, the outer member 20 is moved axially deflecting the wings W so that the lugs may be brought into engagement. The force necessary to deflect the wings W is substantially less than the axial force necessary to keep the inner closure 12 and the outer closure 20 in engagement for loosening the closure during removal of the closure from the container.

Figure 1:
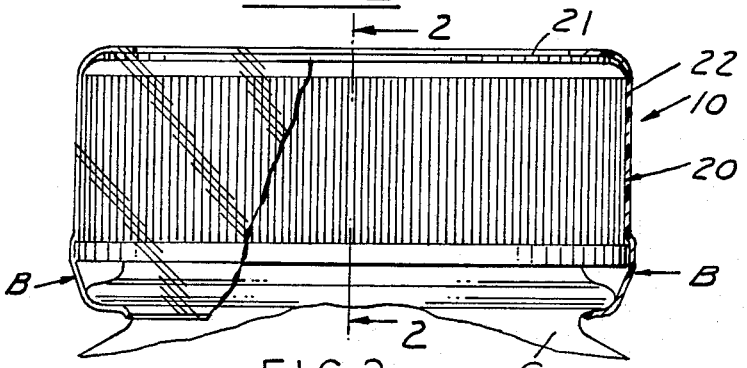
FIG. 1 is a fragmentary elevational view of a package embodying the invention.
Figure 2:
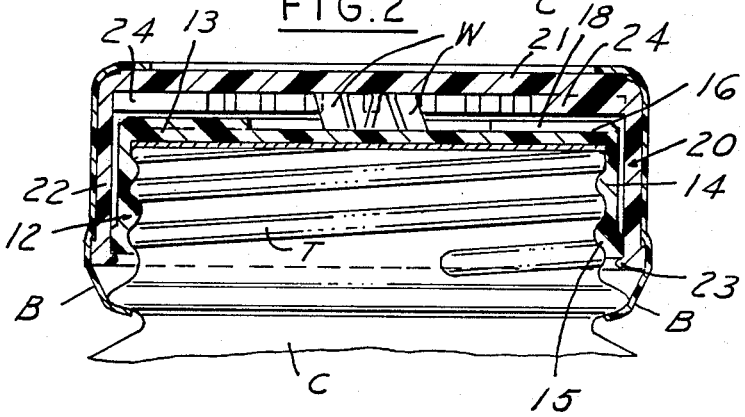
FIG. 2 is a sectional view taken along the line 2—2 in FIG. 1.
Figure 3:
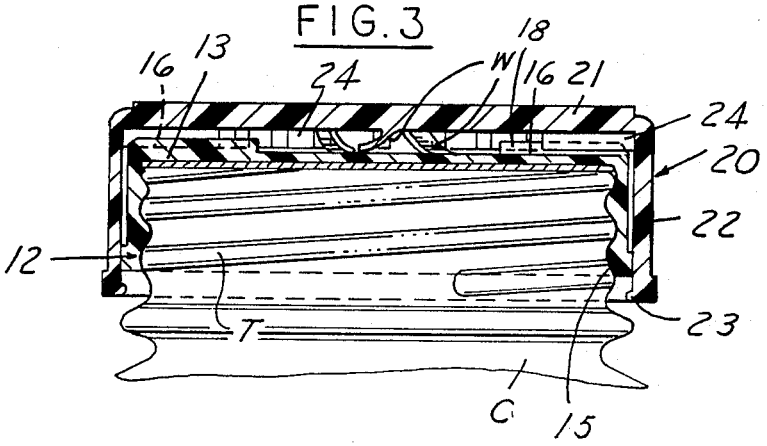
FIG. 3 is a view similar to FIG. 2 showing the relative relationship of the outer and inner closure members during removal of the closure.

The force provided by the wings W is such that it resists any tendency to move the outer closure member when a band B is heat shrunk over the closure and the annular bead B and container C below the threads, after it has been applied to the container (FIGS. 1 and 2).

Figure 8:
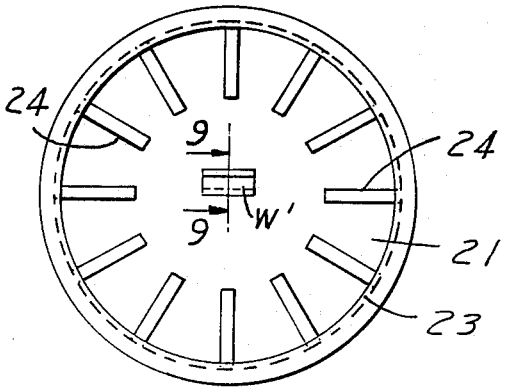
FIG. 8 is a bottom plan view of the base wall of a modified form of outer closure member.
Figure 9:
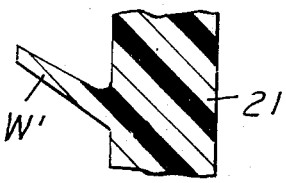
FIG. 9 is a fragmentary sectional view on an enlarged scale taken along the line 9—9 in FIG. 8.

In the modified form shown in FIG. 8, a single wing $W^1$ is provided at the center of the closure which performs the same function.

Each of the wings W, $W^1$ downwardly and rearwardly with respect to the direction of rotation for applying the closure at an acute angle which may be 60°.

It can thus be seen that there has been provided a child resistant closure which will prevent the outer closure member and inner closure member from engaging when a heat shrink band is applied.

I claim:

1. A child resistant closure comprising:

an inner closure and an outer closure, means for retaining the inner closure member within the outer closure, said means permitting limited axial movement of the inner closure within the outer closure member, said inner closure member comprising a base wall, a skirt depending from the periphery of said base wall, threads formed on the inside of said skirt to engage corresponding threads formed on a container finish, and a set of radially aligned lugs formed on the top of said base wall, said outer closure member comprising a base wall, a skirt depending from the periphery of said outer base wall, and a set of depending radial lugs integrally formed on the inside surface of said outer base wall, said sets of lugs constructed and arranged to interengage when said panels are brought together, both sets of lugs having vertical, generally radially extending side surfaces constructed and arranged to abut each other when the outer closure member is rotated in the direction for application of the safety closure, one of said sets of lugs having inclined, generally radially extending side surfaces, constructed and arranged to abut the edges of the other of said sets of lugs when the other closure is rotated in the direction for removal, whereby said sets of lugs will cam out of engagement when the outer closure member is rotated in the direction for removal, unless a firm downward force is applied to said outer closure member, a tamper indicating band comprising a heat shrunk band over said outer closure and a portion of said container, at least one flexible wing extending from one of said outer closure member and inner closure member and yieldingly resisting axial movement between said members such as to hold the outer closure member out of loosening engagement with the inner closure member when the band is heat shrunk over the closure and a portion of the container, the force to deflect the wing being sufficient to hold the outer closure out of loosening engagement when the band is shrunk on the closure and the force being substantially less than the axial force necessary to engage the lugs and prevent the lugs from camming out of engagement in order to move the inner closure member and outer closure member into engagement after the band is removed for loosening the closure during removal of the closure from the container.

2. The child resistant closure set forth in claim 1 including a plurality of such circumferentially spaced wings.

* * * * *